United States Patent [19]

Dortu

[11] 4,212,071

[45] Jul. 8, 1980

[54] METHOD AND DEVICE FOR DRIVING A COMPACTION MACHINE

[75] Inventor: Pierre Dortu, Paris, France

[73] Assignee: Travaux et Produits Routiers Societe a Responsabilite Limitee, Paris, France

[21] Appl. No.: 930,211

[22] Filed: Aug. 2, 1978

[30] Foreign Application Priority Data

Aug. 2, 1977 [FR] France ..... 77 23699

[51] Int. Cl.[2] ..... G06F 15/50

[52] U.S. Cl. ..... 364/505; 175/19

[58] Field of Search ..... 364/450, 505; 404/84; 175/19, 24

[56] References Cited

U.S. PATENT DOCUMENTS 3,870,226 3/1975 Leroy ..... 364/551 X 3,964,834 6/1976 Paramythioti et al. ..... 404/84

*Primary Examiner*—Jerry Smith

*Attorney, Agent, or Firm*—Melville, Strasser, Foster & Hoffman

[57] ABSTRACT

The invention relates to the operation of a compacting machine. At least certain of the data relating to the operating parameters are stored in a memory; the length to be traversed L, the advance length la, the number of passes nP or round-trips to be executed before changing track, and the number of tracks N. The length traversed and the direction of operation are continuously detected, and signals are emitted to control an operation or preferably to inform the driver of the operation to be carried out. The lengths traversed during braking or change in track are taken into account each time in the determination of the length to be traversed. The signals can be given by arrows and fixed or blinking lights. Old or new compaction machines can be driven by the method using this device.

12 Claims, 2 Drawing Figures

METHOD AND DEVICE FOR DRIVING A COMPACTION MACHINE

BACKGROUND OF THE INVENTION

1. Field of the Invention

The present invention relates to a method and a device for driving a compaction machine.

2. Description of the Prior Art

Customarily, in compacting the ground, or materials spread over the latter, a machine is used which includes, for example, rollers which may or may not be vibratory, of steel or with tires.

The driver of the machine carries out by means of the latter, a sufficient number of round trips so that the soil of this area reaches the desired densification.

Ideal compaction, if the surface to be compacted is homogeneous at the start, is such that the machine is passed an equal number of times over each point of this area.

Such an ideal is difficult to achieve by the present technique, which calls mainly on the skill and the regularity of the driver of the machine. To obtain a regular progress of the work, the latter must offset the area covered by the machine on each pass to and fro, that is to say if one calls "work length L" the distance traversed in reverse travel by the machine in a round-trip constituting a pair of passes, and "advance length la" the additional distance traversed in forward travel in the pass which follows this round-trip, then L and la must be kept constant simultaneously, or, stated more simply, the machine must advance each time by a constant length (L=la), and withdraw by a length L, also constant, which is impossible to achieve strictly in the absence of accurate fixed points. In addition, the width of the area to be compacted is often greater than the width processed by the machine in a passage, or "track", which considerably complicates the problem, since after having compacted one track over a certain length, the driver must abandon it to process a length of the adjacent track, and then, after having treated the whole width of the area to be compacted, he must come back to the first track ad resume it at the point where he had left it. Considering that the total width of the area to be compacted is not perforce an exact multiple of the width of the track, one is obliged to accept a certain overlap between one track and its neighbor, which generally is without serious consequences, since the irregularity which can result therefrom is in the longitudinal direction, and less troublesome than if it were transversal.

On the other hand it is important for all the tracks to be compacted in the same manner, and to have undergone the same number of passages.

In the case where materials previously spread by a laying or spreading machine must be compacted, the width of this machine is such that it covers simultaneously two or three tracks with the material to be compacted. It has been observed that it is not possible to obtain a good profile if one track is compacted completely before passing to the neighboring track. Hence it is necessary to operate, for example in the following manner: a round-trip is made over one track and then one passes to another track; when all the tracks have received a round-trip, the cycle is recommenced in the proportion of one round-trip each time on each time, with an offset by an advance length la.

It is an object of the present invention to enable the driving of the machine to be effected such that the work of compaction is in accordance with a pre-established program whilst leaving to the driver the possibility of intervening according to the hazards of the work site, if the latter should require it.

It has already been proposed in the old French Patent No. 459,802 to automatize the changing of the operation of a compactor: a simple mechanical device including a screw rotated by the drive wheel causing a bolt to advance or withdraw according to the direction of working and a bolt acted alternately on two stops one controlling the forward operation, the other the rearward operation. This device hence only permitted round-trips without advancing, and was intended for certain special operations comprising short parameters.

GENERAL DESCRIPTION OF THE INVENTION

In a method according to the invention, a program is prepared using the following parameters determined by simple calculation: the number N of machine tracks necessary to cover the width of the area to be compacted; the work length L; the advance length la; and the number of pairs of passes nP, which is the same for each track.

The program can include the length L and la in the form of wheel revolutions and fractions of wheel revolutions of the equipment. In this case, it is also possible to introduce therein a correction term to take into account the difference between the actual value of the circumference of the wheels and a theoretical reference value.

The program can be prepared on request and on the spot according to the conditions of the time and place. If the latter are sufficiently uniform, it is also possible, of course, to use previously recorded programs.

The data of the program are inserted in a control and signaling device. In addition, the displacements of the machine on the forward run and the return run are detected, including herein braking and change of track manoeuvres, and the various displacements are compared according to this or that function in the cycle of a track to be compacted, with the program. When there is concordance between the portion applied of the program and the value of the displacement, signals are transmitted to inform the driver of the working operation to be carred out manually or to actuate the slaving of the machine.

A device for the practicing of the method according to the invention can be designed to be incorporated in a new machine: advantageously, it is arranged for it to be adapted for a pre-existing machine.

It comprises in this case, a box containing the electronic portion, a unit for the detection of the direction of operation and the distance traversed, and optical and sound signaling members. It comprises in all cases, means for placing in a memory at least one length to be traversed, means sensitive to the length actually traversed, means for comparing these lengths and for emitting indicating or control signals when the length traversed is equal to the programmed length and it is capable of storing in the memory the distance traversed in a braking or change of track manoeuvre and of adding it to the length to be traversed in the course of the run in the reverse direction.

The storage in a memory of parameters extends normally to all operating parameters, and notably the length to be traversed L, the advance length la, the number of pairs of passes nP, the number of tracks N and the working order of the latter.

Certain of these parameters can be recorded beforehand and constitute a program borne on a suitable support such as a cam, a perforated strip, magnetic tape, card, etc. Certain data can be recorded outside the program support; for example, the number of tracks, which is normally equal to 1, 2 or 3, can be indicated by a simple three-position control knob.

The program can correspond to a scanning cycle, this cycle including an equal number of passes over each of the tracks, and means can be provided in addition, to change the start of a cycle. The device can also comprise means for modifying a cycle at will, for example, by eliminating the length la, which permits an operational sequence to be started or ended by a compaction cycle "on the spot".

The corresponding electronic components are obvious to the technician skilled in the art.

In a preferred embodiment, the lengths to be traversed are stored in a memory in numerical form, the lengths traversed are converted into pulses, and the comparison of the lengths traversed and to be traversed is done by counting and counting down.

A simple means for putting the lengths traversed into the form of pulses consists of providing, on a shaft driven by the wheel transmission, a disc bearing at regular intervals towards its periphery, magnetic marks, for example holes, which pass in front of magnetic sensors. If two sensors are used, offset by one half-width of hole plus a whole number of the inter-hole interval, it is very easy to deduce therefrom both the lengths traversed and the direction of travel.

According to an advantageous feature, the lengths to be traversed are translated into numbers corresponding to numbers of revolutions and fractions of a revolution for a theoretical reference circumference of the wheels and the device comprises a means for correcting the indications of length traversed as a function of the actual circumference of the wheels. This feature is particularly advantageous for a device adaptable to preexisting machines, since the same programs can be used on different machines, by means of setting the ratio between the real diameter and the theoretical diameter.

BRIEF DESCRIPTION OF THE DRAWINGS

The invention will be explained in more detail with reference to the accompanying Figures relating to preferred embodiments given by way purely of non-limiting illustration.

DESCRIPTION OF PREFERRED EMBODIMENTS

Figure 1:
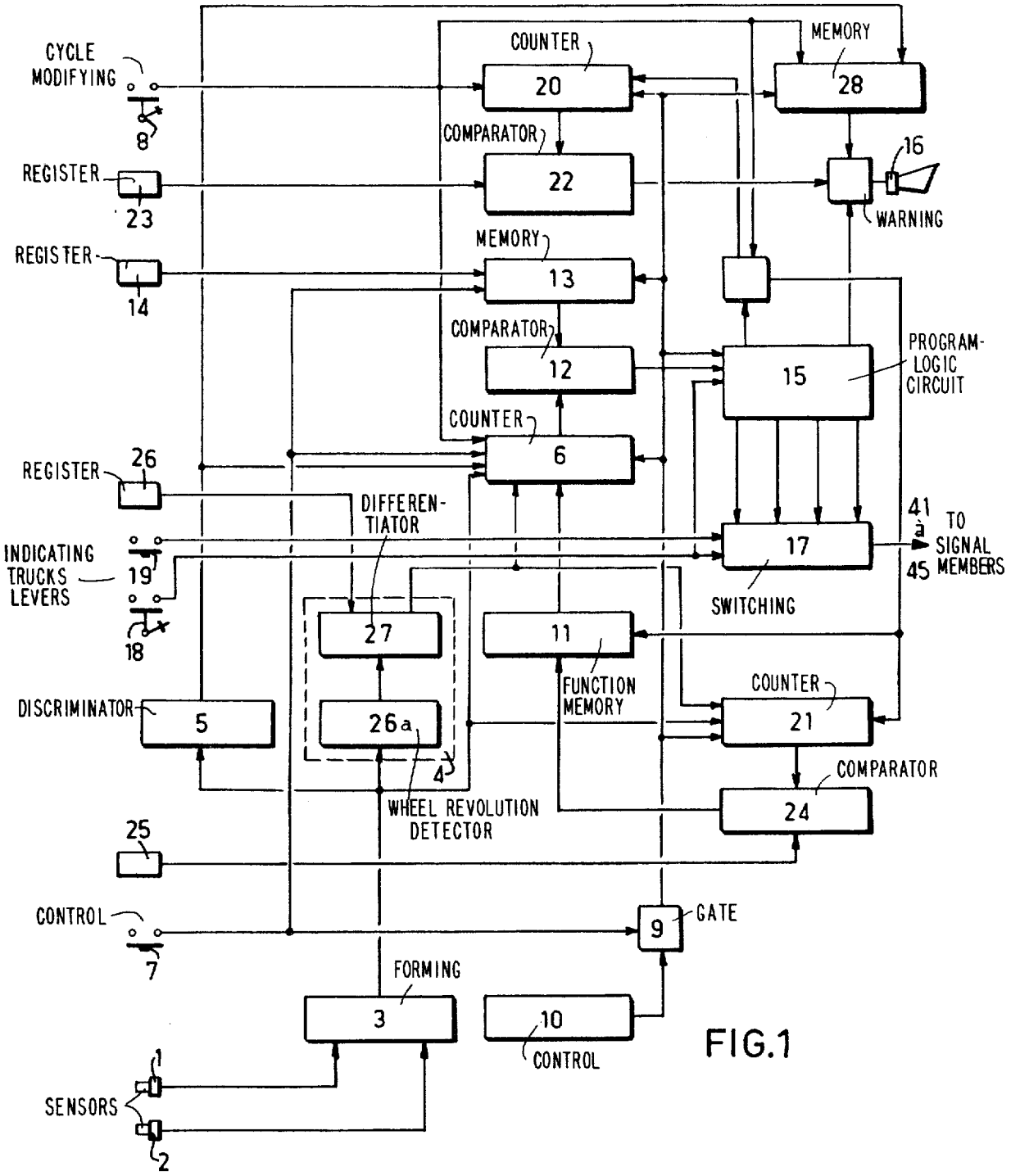
FIG. 1 is a functional diagram of a device according to the invention, described by way of non-limiting example.

Two sensors 1, 2 receive pulses corresponding to the movement of the wheels. These can for example be magnetic sensors in front of which the sectors of a disc driven by the wheel drive transmission shaft pass, these sensors being arranged to enable the detection of both the number of revolutions or fractions of a revolution of the wheels and the direction of advance. The signals from the sensors pass through the forming device 3, then they are sent on the one hand to a wheel diameter corrector 4 and on the other hand, to a sense of rotation discriminator 5.

The diameter correction device for the wheels comprises a register 26 on which is set the difference between the actual diameter and the theoretical diameter of the wheels, a wheel revolution detector 26a and a differentiator 27 which inhibits the counting of the lengths traversed for a proportion corresponding to the difference, that is to say that if, for example, the actual diameter is less than 1/20 of the theoretical diameter, one pulse in twenty will not be counted.

From the forming device 3, the pulses are sent to a ground length traversed counter 6, which counts them after possible correction on the order of the differentiator 27. This counter is controlled by a cycle-starting push-button, and a cycle-modifying push-button 8. It is also controlled by the working direction discriminator 5 which causes it to pass from the "counting" position to the "counting down" position. It is reset to zero on an order which is transmitted to it through an "OR" gate 9 either through the cycle-starting control button 7 or through a control 10 actuated by switching on the power.

The counter 6 also receives signals from the function memory 11 whose control will be explained below.

The signals from the counter 6 are sent to a comparator 12, which receives on the other hand, signals from the length to be compacted memory 13. This memory is supplied by data contained in the program and corresponding to the compacting length L, borne by the register 14, it receives a changing order emitted by the cycle-starting push-button 7, and it is reset to zero by the same signals as the counter 6.

The signals from the comparator 12 are sent into the program logic circuit 15, which contains a register of the successive functions: advance, withdraw, brake, change track, as well as a cycle accumulator, connected on the one hand, to a warning device 16, which signals the change of operations, on the other hand two signaling members 41 and 45 which will be described below, through a switching circuit 17, itself controlled by levers 18, 19 actuated manually and which indicate if the program provides two or three tracks and on which of these tracks the start is to be made.

Orders sent by the program logic to the signal outputs relate to braking, the advance, the withdrawal and the track changing manoeuvre.

The program logic 15 sends in addition, signals to the number of passes counter 20 and to the ground advance length counter 21; it also controls the locking of the function memory 11.

The program logic is connected to the control knob 18 which indicates to it the number of program tracks. Its reset to zero is done as for the ground length traversed counter 6.

The number of passes counter 20, which is placed in operation by the knob 8 is reset to zero at the same time as the program logic, sends signals to the comparator 22, which compares the number of passes effected to the number of passes programmed, which is supplied to it by the register 23. The comparator 22 sends control signals to the warning device 16 to announce a change of operation.

The knob 8 has two positions: in the "working" position, the number of passes counter 210 comes into action, as well as the ground advance counter 21 and the function memory 11 is locked. When the knob 8 is in the "beginning or end of strip-finishing stop" position, the program is modified so that the length la is no longer introduced into the circuit, that is to say the machine works "on the spot".

The ground advance length counter 21 receives pulses arriving from the sensors 1, 2 through the forming device 3 and the wheel length correction circuit 4. It is connected to the same zero reset means as the counter 6. It sends pulses to the comparator 24 of the advance length traversed with the programmed length, the latter being supplied by the programming register 25. The comparator 24 unlocks the function memory 11.

An operation end memory 28 is connected to the knob 8 and to the direction of rotation discriminator 5; it controls the warning device 16 for an "error" signal. The knob 8 places the memory 28 in action when it is in "beginning or end strip-finishing stop" position. This memory counts the number of reverse operation in the course of on the spot working, compares them with the number of passes programmed in this phase and emits the "error" signal when this number is reached.

The operating principle is easily deduced from the diagram. Assume that the equipment starts by a rearward operation: the comparison of the length to be compacted L and the length traversed lp gives, at the start, a value $L-lp=L$ since $lp=0$. This value diminishes in accordance with the movement of the equipment and, when it is canceled, the program logic 15 sends a signal which is a stop order. During braking, the value L−lp continues to decrease through negative values, until the stop. At the moment when the equipment starts again in reverse direction, the discriminator 5 sends a count-count down change of direction order and the value L−lp is set to vary in reverse sense passing first through negative values, then zeroing and becoming positive. The assembly formed by the counter 21, the comparator 24 and the function memory 11 permits, on order from the logic 15, the length of advance la to be only introduced into the counting on forward operation and on the selected track, provided that the knob 8 is in the "working" position.

The number of passes carried out are also transmitted through the logic 15 to the counter 20 and compared similarly to the numbers of programmed passes.

Figure 2:
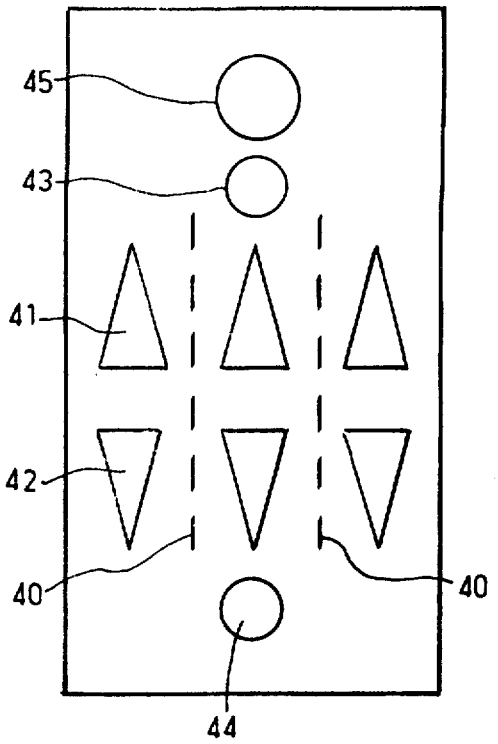
FIG. 2 is a view of an example of the display board.

FIG. 2 shows a display panel for equiping a machine operating on three tracks. The tracks are shown by means of lines 40, the direction of operation to be observed is indicated by the green arrows 41, 42 which remain lit as long as L is not traversed; the yellow light 43 corresponds to the order to continue advancing for length la, the fixed red light 45 to the braking and stop order, after forward operation, and the blinking red light 44 to the braking and stop order after rearward operation, this order being normally followed by the lighting of an arrow corresponding to another track.

By "forward operation", is meant that the machine advances in the same direction as the spreading machine.

It will be noted in addition, that it is possible for cases where hazards of the terrain are not to be anticipated, to send signals actuating the light signals to machine slaving mechanisms, so as to provide fully automatic or partly automatic operation.

I claim:

1. Method for driving a compaction machine over an area of ground, said method comprising: causing the machine to perform a certain number of passages to and fro in said area, preparing a program beforehand comprising the appropriate number of to and fro passages, as well as the length of each of them, recording said program, detecting the movements of the machine in one direction and in the other, comparing the movements of the machine with those provided by the program and transmitting signals, such as optical or sound signals, to inform the driver of the operation to follow, and when a length equal to the length provided in the program has been traversed in one direction or in the other in the course of a round-trip, recording the length traversed by the machine beyond the length provided by the program until it is stopped to change direction of operation, and therefrom increasing the path to be traversed in the opposite direction by a length equal to the thus recorded length.

2. Method according to claim 1, wherein the program includes the appropriate number of round-trips to be made on one track before passing onto a parallel track and wherein, when this number is reached, signals are emitted to inform the driver that he should change track.

3. Method according to claim 2, wherein the program includes the number of tracks to be worked before coming back to the starting track and wherein, when this number is reached, signals are transmitted to inform the driver that it is necessary to return to the starting track.

4. Device for driving or assisting in driving a compaction machine according to a program, and comprising means for storing in a memory at least one programmed length to be traversed, means sensitive to the length actually traversed, means for comparing these lengths and for emitting indicating or control signals when the length traversed is equal to the programmed length, wherein the device is adapted to store in the memory the distance traversed in an operation of braking or change of track and to add it to the length to be traversed in the course of the operation in reverse direction.

5. Device according to claim 4, comprising means for storing in the memory at least certain of the operating parameters of the machine, namely the length to be traversed L, the advance length la, the number of pairs of passages nP, the number of tracks N and the order of working the latter.

6. Device according to claim 5, wherein the lengths to be traversed are stored in a memory in numerical form, wherein the lengths traversed are converted into pulses, and wherein the comparison of the lengths traversed and to be traversed is done by counting and counting down.

7. Device according to claim 5, wherein the lengths traversed are translated into numbers corresponding to numbers of revolutions and fractions of a revolution for a theoretical reference circumference of the wheels, and comprising means for correcting the indications of the length traversed according to the actual circumference of the wheels.

8. Device according to claim 4, wherein the lengths to be traversed are stored in a memory in numerical form, wherein the lengths traversed are converted into pulses, and wherein the comparison of the lengths traversed and to be traversed is done by counting and counting down.

9. Device according to claim 8, comprising a programming logic circuit which, when the difference between the length traversed and the programmed length passes through values selected before hand, is able to send signals to indicating members, to circuits enabling the advance length to be introduced into the means for the comparison of the lengths traversed and to be traversed and/or counting circuits for the numbers of pairs of passes.

10. Device according to claim 9, comprising means for actuating in operation the stopping of the introduction of the advance length la into the means for the comparison of the lengths traversed and to be traversed, so as to obtain "on the spot" working.

11. Device according to claim 8, comprising means for actuating in operation the stopping of the introduction of the advance length la into the counting circuits, so as to obtain "on the spot" working.

12. Device according to claim 4, wherein the lengths traversed are translated into numbers corresponding to numbers of revolutions and fractions of a revolution for a theoretical reference circumference of the wheels, and comprising means for correcting the indications of the length traversed according to the actual circumference of the wheels.

* * * * *